US007558522B2

(12) United States Patent
Ogasawara et al.

(10) Patent No.: US 7,558,522 B2
(45) Date of Patent: Jul. 7, 2009

(54) IMAGE FORMING APPARATUS HAVING TONER CLEANER AND TONER CLEANING METHOD

(75) Inventors: Masato Ogasawara, Katsushika-ku (JP); Kazufumi Ishida, Sunto-Gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 490 days.

(21) Appl. No.: 11/397,435

(22) Filed: Apr. 4, 2006

(65) Prior Publication Data

US 2007/0230990 A1 Oct. 4, 2007

(51) Int. Cl.
*G03G 21/00* (2006.01)
*G03G 15/16* (2006.01)
*G03G 15/20* (2006.01)

(52) U.S. Cl. ..... 399/358; 399/101; 399/123

(58) Field of Classification Search ..... 399/101, 399/123, 297, 343, 345, 358, 359, 360
See application file for complete search history.

(56) References Cited

U.S. PATENT DOCUMENTS 5,483,323 A * 1/1996 Matsuda et al. ..... 399/345 X
5,848,343 A * 12/1998 Takahashi et al. ..... 399/359
7,194,232 B2 * 3/2007 Kitagawa et al. ..... 399/297
7,233,766 B2 * 6/2007 Matsuyama et al. ..... 399/358

FOREIGN PATENT DOCUMENTS

JP 10-301460 11/1998

* cited by examiner

*Primary Examiner*—Sandra L Brase
(74) *Attorney, Agent, or Firm*—Turocy & Watson, LLP

(57) ABSTRACT

An image forming apparatus according to one embodiment of the invention includes an image carrier and a cleaning device for cleaning a developer left on a surface of the image carrier. Further, the cleaning device includes: a casing having a rotational shaft; a pressurizing member for applying a force about the rotational shaft to the casing; a cleaning member fixed to the casing for cleaning the developer left on the surface of the image carrier by pressing against the surface by the force about the rotational shaft; a transporting mechanism for transporting the developer in the casing to a position outside of the casing; and a drive mechanism for providing a driving force to the transporting means, and a direction of the driving force is a direction from an application point of the driving force substantially toward a rotational support of the rotational shaft or a direction opposite thereto.

19 Claims, 7 Drawing Sheets

IMAGE FORMING APPARATUS HAVING TONER CLEANER AND TONER CLEANING METHOD

BACKGROUND OF THE INVENTION

1. Technical Field of the Invention

The present invention relates to an image forming apparatus and an image forming method, and specifically, to an image forming apparatus having a toner cleaner for removing toner attached onto an image carrier such as a photoconductor, a transfer body, or an intermediate transfer body, and an image forming method therefor.

2. Related Art

In an electrophotographic image forming apparatus, development is performed using a developer such as toner. By a developing unit, a toner image is formed for an electrostatic latent image formed on a surface of a photoconductor. The toner image is transferred onto recording paper supplied from a paper feed tray or the like by a transfer unit. The toner image transferred onto the recording paper is fixed by a fixing unit.

On the one hand, the toner left on the photoconductor after transfer is removed by a toner cleaner, and used for forming a new electrostatic latent image or toner image. In the image forming apparatus, a mechanism for efficiently removing toner and ejecting the removed toner to the outside is essential and important.

Accordingly, for example, as disclosed in Patent Document (JP 10-301460 A), various kinds of toner eject mechanisms have been conventionally proposed.

On the other hand, there are many image forming apparatuses of type that the toner image formed on the photoconductor is once transferred onto an intermediate transfer body such as an intermediate transfer belt, and the toner image transferred onto the intermediate transfer body is transferred onto recording paper. In the image forming apparatus of this type, since toner is left not only on the photoconductor but also on the intermediate transfer body, toner cleaners are often provided for both the photoconductor and the intermediate transfer body.

As a technology of cleaning toner attached to the photoconductor, intermediate transfer body, etc. (these are generally named as an image carrier), a technology of removing toner by pressing an elastic body of urethane rubber or the like molded in a blade shape (hereinafter, referred to as "cleaning blade") against the image carrier has been generally used.

For example, the toner cleaner includes a cleaning blade formed by attaching a rubber material having a free length of specified length to a base such as a metal plate, transporting means for transporting the toner removed from the image carrier by the cleaning blade (hereinafter, referred as "waste toner") to a predetermined position, a casing for accommodating the cleaning blade and the transporting means, etc.

As methods of pressing the cleaning blade against the image carrier, there are a fixed position method by which the cleaning blade is fixed to the casing fixed relative to the image carrier and a fixed weight method by which a specified weight is applied to the cleaning blade by pressurizing means such as a spring.

In the fixed position method, although the structure is relatively simple, the force of the cleaning blade pressing the image carrier (pressing force) varies widely due to the attachment error of the cleaning blade relative to the position of the image carrier, variations in dimension precision of the cleaning blade alone, change of the cleaning blade over time, environmental dependency of elasticity, etc., and the method has a disadvantage that the cleaning performance of the cleaning blade is unstable.

Contrary, pressing force varies little in the fixed weight method and the method can realize stable cleaning performance.

The fixed weight method is further classified into the following two methods. One has a form in which a holder having the cleaning blade, a rotational part, and an attachment part of the spring is rotatably supported by a casing and only the holder and the cleaning blade are moved relative to the image carrier. In this method, sealing with a sponge or the like is needed for preventing leak of toner from a gap between the cleaning blade and the casing, and there is a disadvantage that it is difficult to realize effective sealing because the seal moves relative to the casing.

The other method is a method of fixing the cleaning blade to the casing and pressurizing the entire casing including the transporting means of waste toner by the spring or the like for pressing the cleaning blade to the image carrier (hereinafter, referred to as "transportation integrated blade method"). In the transportation integrated blade method, the cleaning blade does not move relative to the casing, and the method has an advantage that the prevention of waste toner leaking from the casing becomes easier.

However, in the transportation integrated blade method, since the transporting means and the cleaning blade are fixed to the casing, there has been a problem that the variation in force received by the transporting means easily leads to the variation in pressing force of the cleaning blade, and consequently, the variation is likely to cause a phenomenon that the cleaning blade is flipped and degradation in cleaning performance of the cleaning blade.

SUMMARY OF THE INVENTION

The invention has been achieved in view of the above circumstances, and a purpose thereof is to provide an image forming apparatus capable of preventing the variation in pressing force of a cleaning blade for cleaning residual toner on an image carrier and stabilizing the cleaning performance of the cleaning blade and an image forming method.

In order to accomplish the purpose, an image forming apparatus according to one aspect of the invention includes: an image carrier; and a cleaning device for cleaning a developer left on a surface of the image carrier, and the cleaning device includes: a casing having a rotational shaft; pressurizing means for applying a force about the rotational shaft to the casing; a cleaning member provided in the casing for cleaning the developer left on the surface of the image carrier by being partly pressed against the surface of the image carrier by the force about the rotational shaft; transporting means accommodated in the casing for transporting the cleaned developer collecting within the casing to a predetermined position outside of the casing; and drive providing means for providing a driving force to the transporting means, wherein a direction of the driving force is a direction from an application point of the driving force substantially toward a rotational support of the rotational shaft or a direction opposite thereto.

Further, in order to accomplish the purpose, an image forming apparatus according to one aspect of the invention includes: an image carrier; and a cleaning device for cleaning a developer left on a surface of the image carrier, and the cleaning device includes: a casing having a rotational shaft; a pressurizing member for applying a force about the rotational shaft to the casing; a cleaning member provided in the casing for cleaning the developer left on the surface of the image carrier by being partly pressed against the surface of the image carrier by the force about the rotational shaft; a transport mechanism accommodated in the casing for transporting the cleaned developer collecting within the casing to a predetermined position outside of the casing; and a drive provision mechanism for providing a driving force to the transport mechanism, wherein a direction of the driving force is a direction from an application point of the driving force substantially toward a rotational support of the rotational shaft or a direction opposite thereto.

Furthermore, in order to accomplish the purpose, an image forming method according to one aspect of the invention, in an image forming method of an image forming apparatus, includes: exposing a surface of a photoconductor to light of an electrostatic latent image; developing the electrostatic latent image with toner to develop a toner image on the surface of the photoconductor; transferring the toner image on the surface of the photoconductor onto an intermediate transfer body; transferring a transferred image transferred to the intermediate transfer body onto a recording medium; and cleaning toner left on the intermediate transfer body or photoconductor, and the cleaning includes: applying a force about a rotational shaft to a casing having the rotational shaft; scraping the toner left on a surface of the intermediate transfer body or photoconductor by a cleaning blade fixed to the casing and partly pressed against the surface of the intermediate transfer body or photoconductor by the force about the rotational shaft; transporting the toner scraped into the casing to a predetermined position outside of the casing by an auger accommodated in the casing; and providing a driving force to the auger, wherein a direction of the driving force is a direction from an application point of the driving force substantially toward a rotational support of the rotational shaft or a direction opposite thereto.

BRIEF DESCRIPTION OF THE DRAWINGS

In accompanying drawings.

DETAILED DESCRIPTION OF THE EMBODIMENTS

Embodiments of an image forming apparatus and an image forming method according to the invention will be described by referring to the accompanying drawings.

(1) Configuration of Image Forming Apparatus

Figure 1:
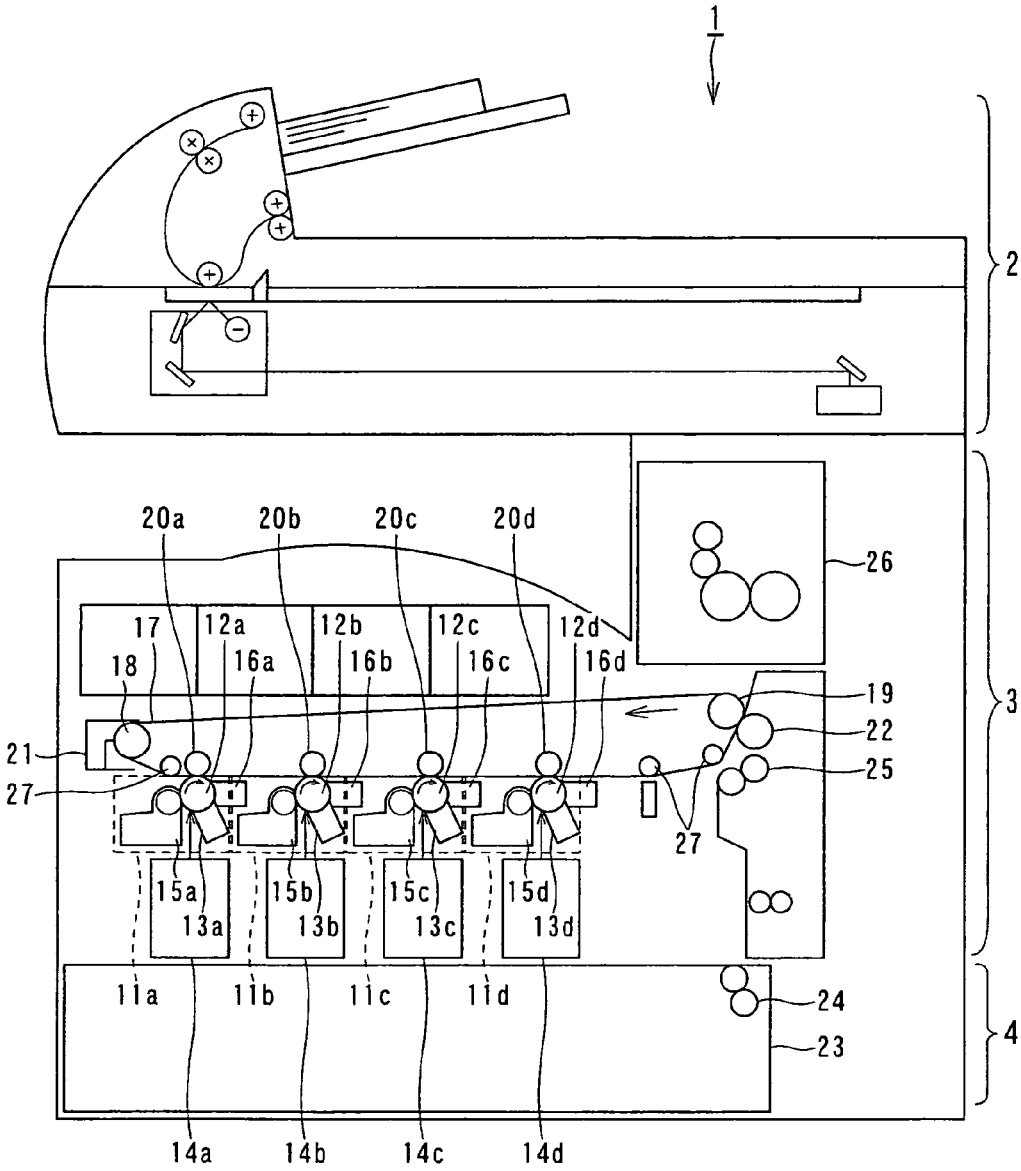
FIG. 1 shows an overall configuration example of an image forming apparatus according to an embodiment of the invention.

FIG. 1 shows a configuration example of an image forming apparatus 1 according to one embodiment of the invention.

As shown in FIG. 1, the image forming apparatus 1 includes a scanner part 2, an image forming part 3, and a paper feed part 4.

The scanner part 2 irradiates an original set on a platen with light, guides the reflected light from the original to light receiving elements via plural optical members, performs photoelectric conversion thereon, and supplies image signals to the image forming part 3.

Four process cartridges 11*a*, 11*b*, 11*c*, and 11*d* are provided in the image forming part 3. The process cartridges 11*a*, 11*b*, 11*c*, and 11*d* correspond to yellow (Y), magenta (M), cyan (C), and black (K) and have photoconductor drums (photoconductors) 12*a*, 12*b*, 12*c*, and 12*d* as image carriers, respectively. Developer images of toner (toner images) or the like are formed on these photoconductor drums.

The photoconductor drum 12*a* has a cylindrical shape of 30 mm in diameter, for example, and is provided rotatably in a direction of an arrow in the drawing. Around the photoconductor drum 12*a*, devices pertaining thereto are provided along the rotational direction. First, a charging charger 13*a* is provided facing the surface of the photoconductor drum 12*a* as a device pertaining thereto. The charging charger 13*a* uniformly and negatively (−) charges the photoconductor drum 12*a*. At the downstream of the charging charger 13*a*, an exposure device 14*a* for exposing the charged photoconductor drum 12*a* to light to form an electrostatic latent image is provided. The exposure device 14*a* exposes the photoconductor drum 12*a* to light using a laser beam optically modulated in response to an image signal supplied from the scanner part 2. The exposure device 14*a* may use an LED (Light Emitting Diode) in place of the laser beam.

At the further downstream side of the exposure device 14*a*, a developing unit 15*a* for performing reversal development of the electrostatic latent image formed by the exposure device 14*a* is provided. In the developing unit 15*a*, a developer of yellow (Y) is accommodated.

At the downstream side of the developing unit 15*a*, an intermediate transfer belt 17 as an intermediate transfer body as one of image carriers is provided in contact with the photoconductor drum 12*a*.

The intermediate transfer belt 17 has a length (width) nearly equal to the length along the shaft direction of the photoconductor drum 12*a* in a direction perpendicular to the transport direction (in the depth direction of the drawing). The intermediate transfer belt 17 has a shape of endless (seamless) belt, and is wrapped around a driving roller 18 that rotates the belt at a predetermined speed and a secondary transfer opposing roller 19 as a driven roller and carried. A tension roller 27 for holding the intermediate transfer belt 17 at constant tension is provided at the downstream side of the driving roller 18.

The intermediate transfer belt 17 is formed by polyimide having a thickness of 100 μm, for example, in which carbon has been uniformly dispersed, and the intermediate transfer belt 17 has electric resistance of about $10^{-9}$ Ωcm, for example, and exhibits semiconductivity. As a material of the intermediate transfer belt 17, a material exhibiting semiconductivity with volume resistance value from $10^{-8}$ to $10^{-11}$ Ωcm may be used. For example, not only polyimide with carbon dispersed but also polyethylene terephthalate, polycarbonate, polytetrafluoroethylene, polyvinylidene fluoride, etc. with conductive particles such as carbon dispersed may be used. A polymer film with electric resistance adjusted by composition adjustment may be used without using conductive particles. Furthermore, a material formed by mixing an ionic conductive material in such a polymer film, or a rubber material such as silicon rubber and urethane rubber having relatively low electric resistance may be used.

A toner cleaner (cleaning device) 16*a* is provided at the further downstream side of the contact position between the photoconductor drum 12*a* and the intermediate transfer belt 17. The toner cleaner 16*a* removes and collects residual toner on the photoconductor after transfer by a cleaning blade (cleaning member) 16-1 (see FIG. 2). A static elimination lamp 31 (see FIG. 2) eliminates surface charge of the photoconductor drum 12*a* with uniform light irradiation. Thereby, one cycle of image formation is completed, and, in the next image formation process, the charging charger 13*a* uniformly charges the uncharged photoconductor drum 12*a* again.

Not only the process cartridge 11*a* but also the process cartridges 11*b*, 11*c*, and 11*d* are sequentially provided between the driving roller 18 and the secondary transfer opposing roller 19 along the transport direction of the intermediate transfer belt 17. All of the respective process cartridges 11*b*, 11*c*, and 11*d* have the same configuration as that of the process cartridge 11*a*.

That is, the photoconductor drums 12*b*, 12*c*, and 12*d* are provided nearly at the center of the respective process cartridges. Further, charging chargers 13*b*, 13*c*, and 13*d* are respectively provided facing the surfaces of the respective photoconductor drums 12*b*, 12*c*, and 12*d*. At the downstream of the charging chargers 13*b*, 13*c*, and 13*d*, exposure devices 14*b*, 14*c*, and 14*d* for exposing the charged photoconductor drums 12*b*, 12*c*, and 12*d* to light to form electrostatic latent images are provided. At the further downstream side of the exposure devices 14*b*, 14*c*, and 14*d*, developing units 15*b*, 15*c*, and 15*d* for performing reversal development of the electrostatic latent images formed by the exposure devices 14*b*, 14*c*, and 14*d* are provided. Toner cleaners 16*b*, 16*c*, and 16*d* are provided at the downstream side of the contact positions between the photoconductor drums 12*b*, 12*c*, and 12*d* and the intermediate transfer belt 17. A developer of magenta (M), a developer of cyan (C), and a developer of black (K) are accommodated in the developing units 15*b*, 15*c*, and 15*d*, respectively.

The intermediate transfer belt 17 sequentially contacts the respective photoconductor drums (photoconductors 12*a* to 12*d*). In the vicinities of the contact positions of the intermediate transfer belt 17 and the respective photoconductor drums, primary transfer rollers 20*a*, 20*b*, 20*c*, and 20*d* are provided correspondingly to the respective photoconductor drums. That is, the primary transfer rollers 20*a* to 20*d* are provided in contact with the intermediate transfer belt 17 at the rear side above the corresponding photoconductor drums, and opposed to the process cartridges 11*a* to 11*d* via the intermediate transfer belt 17. The primary transfer rollers 20*a* to 20*d* are connected to a positive (+) direct-current power supply (not shown) as voltage applying means. Because of the positive (+) application voltages, the toner images formed on the respective drums 12*a* to 12*d* are transferred onto the intermediate transfer belt 17.

In the vicinity of the driving roller 18 that drives the intermediate transfer belt 17, an intermediate transfer belt cleaner (toner cleaner: cleaning device) 21 for removing and collecting residual toner on the intermediate transfer belt 17 is provided.

On the other hand, below the image forming part 3, a paper feed cassette 23 of the paper feed part 4 accommodating paper (transfer material) is provided. A pickup roller 24 for picking up paper one by one from the paper feed cassette 23 is further provided in the paper feed part 4. Near a secondary transfer roller 22 of the image forming part 3, a pair of resist rollers 25 are rotatably provided. The pair of resist rollers 25 supply paper to the secondary transfer roller 22 and the secondary transfer opposing roller 19 facing each other with the intermediate transfer belt 17 in between (secondary transfer part) at predetermined timing.

Further, above the intermediate transfer belt 17, a fixing unit 26 for fixing the developer on the paper is provided. The fixing unit 26 applies predetermined heat and pressure to the paper holding the toner image and fixes the fused toner image to the paper.

Note that, since the respective process cartridges 11*a* to 11*d* have the same configuration, they are generally named as a process cartridge 11 as below in the case where there is no need to distinguish them. Further, the respective parts provided in the process cartridge 11 (11*a* to 11*d*) are similarly named.

Figure 2:
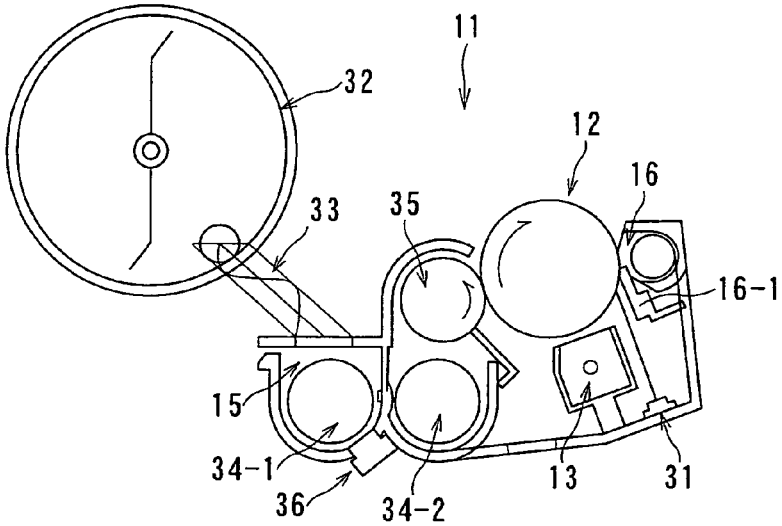
FIG. 2 shows a configuration example of a process cartridge of the image forming apparatus according to the embodiment of the invention.

FIG. 2 shows a schematic configuration within the process cartridge 11.

The process cartridge 11 is formed integrally by the photoconductor drum 12, the charging charger 13, the developing unit 15, and the cleaner 16, and detachable from the image forming apparatus 1 main body.

The developing unit 15 is provided facing the photoconductor drum 12 in a predetermined position. At the downstream side of the development position facing the developing unit 15 of the photoconductor drum 12 in the rotational direction, the toner cleaner 16, the static elimination lamp 31, and the charging charger 13 are sequentially provided. A toner cartridge 32 for accommodating fresh toner is detachably provided to the image forming apparatus 1, and connected to the developing unit 15 within the image forming apparatus 1 via a supply motor auger 33 to supply fresh toner to the developing unit 15. The supply motor auger 33 supplies a predetermined amount of the toner from the toner cartridge 32 to the developing unit 15.

Inside of the developing unit 15, a mixer 34-1 and a mixer 34-2 for stirring and charging toner supplied from the toner cartridge 32 via the supply motor auger 33 and carrier that has been accommodated within the developing unit 15 in advance are provided. Above the mixer 34-1 and mixer 34-2 within the developing unit 15, a developing sleeve 35 having an internal magnet for transporting a two-component developer including toner and carrier stirred and charged by the mixer 34-1 and mixer 34-2 to a development position is provided. In the vicinity below the developing unit 15, a sensor for sensing toner density within the developing unit 15, for example, a magnetic sensor 36 is provided.

Note that the above developer is a two-component developer including toner and carrier, however, a one-component developer including toner only may be used.

(2) Image Formation Operation of Image Forming Apparatus

Next, color image formation operation (printing processing) of the image forming apparatus 1 will be described.

When the start of image formation operation is instructed (that is, when an instruction to start printing is given), the photoconductor drum 12*a* receives a driving force from a driving mechanism (not shown) and starts rotating. The charging charger 13*a* uniformly charges the photoconductor drum 12*a* to about −600 V, for example. The exposure device 14*a* irradiates the photoconductor drum 12 uniformly charged by the charging charger 13*a* with light according to an image to be printed and forms an electrostatic latent image. The developing unit 15*a* accommodates a developer (e.g., a two-component developer including Y-toner of yellow and ferrite carrier), provides a bias value, for example, −380 V to the developing sleeve 35 by a developing bias supply (not shown), and forms a developing field between the photoconductor drum 12*a* and itself. The negatively charged Y-toner attaches an area of image part potential of the electrostatic latent image of the photoconductor 12*a* and forms a Y-toner image on the surface of the photoconductor drum 12*a*.

Similarly, a magenta (M) toner image, a cyan (C) toner image, and a black (K) toner image are formed on the surface of photoconductor drums 12*b*, 12*c*, and 12*d*, respectively.

In the position where the photoconductor drum 12*a* and the intermediate transfer belt 17 contact, the primary transfer roller 20*a* is provided with the intermediate transfer belt 17 in between. A required voltage, a bias voltage of about +1000 V, for example, is applied to the primary transfer roller 20*a*. A transfer field is formed between the primary transfer roller 20*a* and the photoconductor drum 12*a* by the bias voltage, and the Y-toner image on the photoconductor drum 12*a* is transferred onto the intermediate transfer belt 17 according to the transfer field.

The image on the intermediate transfer belt 17 formed by transferring the Y-toner image is carried to the position facing the photoconductor drum 12*b*, and, here, the M-toner image on the photoconductor drum 12*b* is transferred on the Y-toner image on the intermediate transfer belt 17.

Subsequently, similarly, the C-toner image on the photoconductor drum 12*c* and the K-toner image on the photoconductor drum 12*d* are sequentially multiple-transferred onto the intermediate transfer belt 17.

Thus, the respective toner images of Y, M, C, and K are transferred to be overlapped onto the intermediate transfer belt 17, and thereby, a color toner transferred image is formed.

On the other hand, the pickup roller 24 takes paper from the paper feed cassette 23, and the pair of resist rollers 25 supply the paper to the secondary transfer part.

In the secondary transfer part, the secondary transfer opposing roller 19 is applied with a required bias voltage to form the transfer field between the secondary transfer roller 22 and itself with the intermediate transfer belt 17 in between. The color toner transferred image on the intermediate transfer belt 17 is transferred by one operation onto the paper by the transfer field. The developer images (toner images) of the respective colors transferred by one operation are fixed onto the paper by the fixing unit 26, and thereby, a color image is finally formed on the paper. The fixed paper is ejected onto a paper ejection part within the cylinder (not shown).

After secondary transfer, residual toner left on the surface of the intermediate transfer belt 17 is removed by the intermediate transfer belt cleaner 21.

(3) Configuration and Operation of Intermediate Transfer Belt Cleaner

Figure 3:
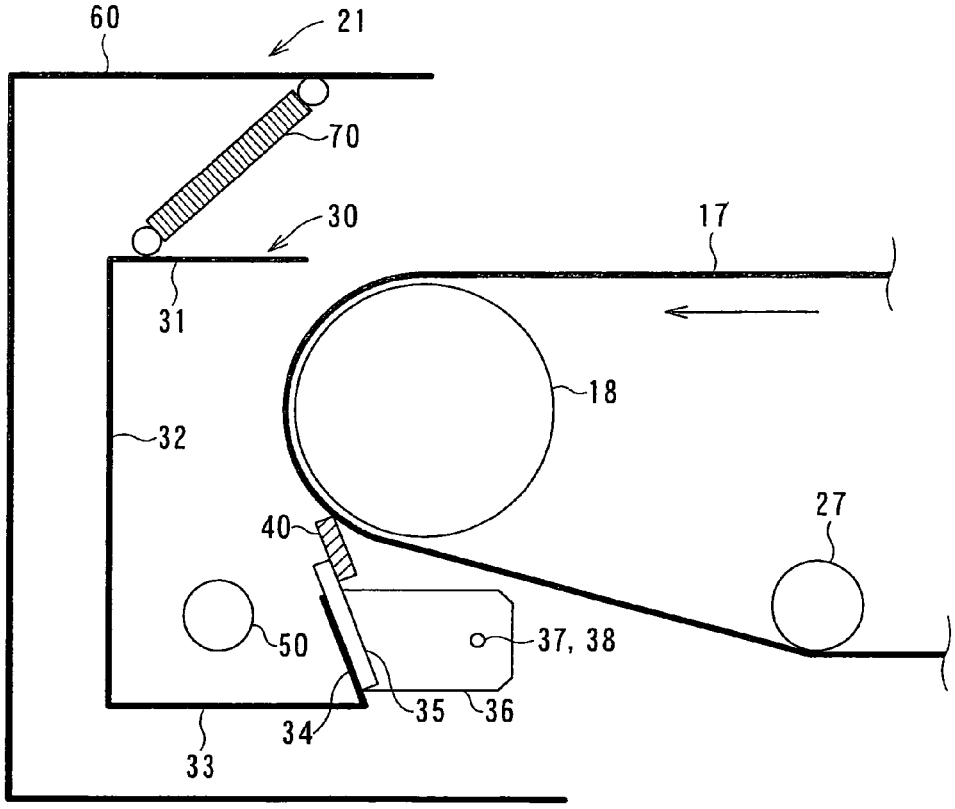
FIG. 3 shows a configuration example of a toner cleaner and the vicinity thereof in image forming apparatus according to the embodiment of the invention.

FIG. 3 is an enlarged sectional view showing the intermediate transfer belt cleaner 21 and the structure nearby of the configuration of the image forming apparatus 1 shown in FIG. 1.

The intermediate transfer belt cleaner 21 is provided near the driving roller 18 for driving the intermediate transfer belt 17. The intermediate transfer belt 17 continuously circulates between the driving roller 18 and the secondary transfer opposing roller 19 provided at the opposite side thereto by the driving force of the driving roller 18. Further, appropriate tensile force is held by the tension roller 27.

The intermediate transfer belt cleaner 21 includes a casing 30 having a substantially C-shaped section, a cleaning blade (cleaning member) 40 with one end fixed to the casing 30 and the other end in contact with the intermediate transfer belt 17 moving on the driving roller 18, and an auger (transporting means or transport mechanism) 50 accommodated within the casing 30 for transporting waste toner in the shaft direction (the direction perpendicular to the paper surface).

Further, the intermediate transfer belt cleaner 21 includes a cleaner case 60 fixed to the main body side of the image forming apparatus 1 for covering the intermediate transfer belt cleaner 21, and an elastic body 70, for example, a coil spring 70 as pressurizing means (pressurizing member) with one end fixed to a top plate 31 of the casing 30 and the other end fixed to the cleaner case 60.

The casing 30 includes the top plate 31, a first side plate 32, a bottom plate 33, and a second side plate 34, and a duct shape with the surface facing the intermediate transfer belt 17 partly opened. Further, the casing 30 has a support plate 36 extending from the second side plate 34 side.

The casing 30 is supported via the support plate 36 rotatably about a rotational support 38 by a rotational shaft 37 provided at the main body side of the image forming apparatus 1.

The cleaning blade 40 is formed by attaching an elastic body of urethane rubber or the like molded in a blade shape to a base such as a metal plate. The base is fixed to the second side plate 34 of the casing 30 via an attaching member 35. On the other hand, the leading end of the cleaning blade 40 formed by the elastic body such as urethane rubber is pressed against the intermediate transfer belt 17 with suitable pressing force by the force about the rotational support 38 produced by the pulling force of the coil spring 70.

By the pressing of the cleaning blade 40, the residual toner attached to the intermediate transfer belt 17 is scraped, dropped in the casing 30 as waste toner, and collected within the casing 30.

The waste toner collected in the casing 30 is transported to a predetermined position outside of the casing 30 by the auger 50 and received by a waste toner receiver (not shown).

The auger 50 is transporting means (transport mechanism) having a drill-shaped continuous spiral fin, for example. By rotating the auger 50, the waste toner is transported on the continuous spiral fin in the shaft direction (the direction perpendicular to the paper surface), and injected into the waste toner receiver from an end of the casing 30.

In the above configuration, in order to satisfactorily remove the residual toner on the intermediate transfer belt 17, it is important that the force with which the cleaning blade 40 is pressed against the intermediate transfer belt 17 is maintained within an adequate range.

When the pressing force is weaker, the residual toner can not be removed sufficiently. On the other hand, when the pressing force is too strong, the cleaning blade 40 is flipped by the frictional force between the cleaning blade 40 and the intermediate transfer belt 17, and consequently, the removal performance of residual toner can not be assured.

The pressing force of the cleaning blade 40 against the intermediate transfer belt 17 is affected not only by the pulling force by the coil spring 70 but also by the driving force of the auger 50.

Figure 4:
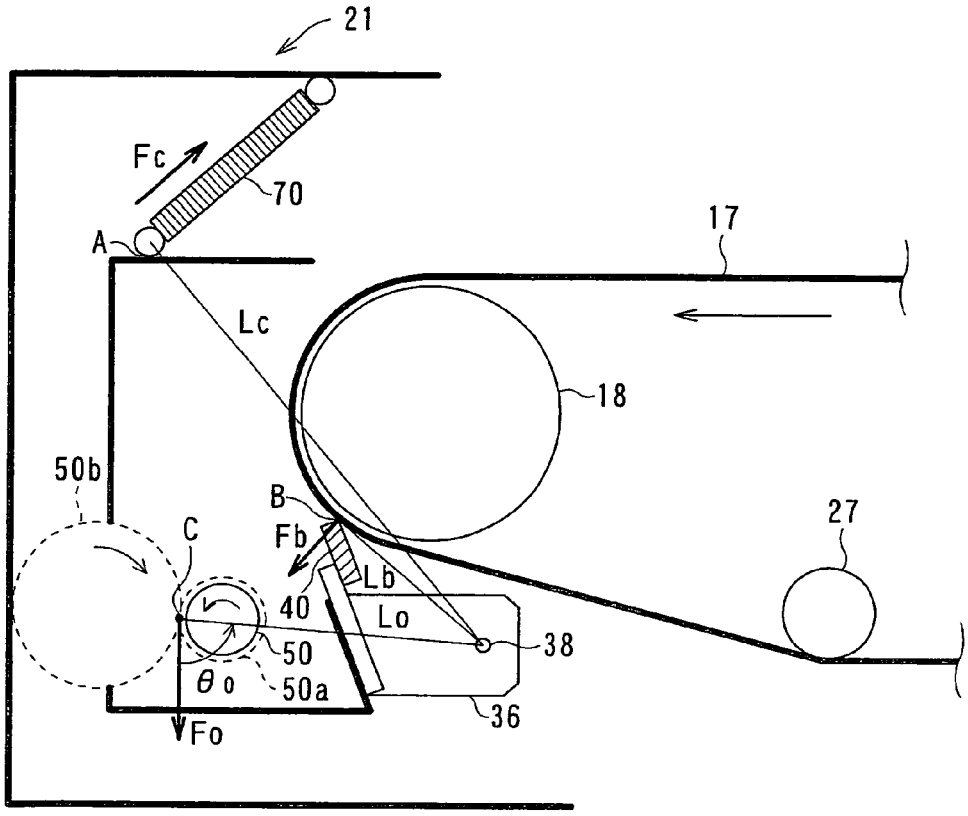
FIG. 4 is a diagram for explanation of a relationship among a pressing force of a cleaning blade, a pulling force of a coil spring, and a driving force of an auger as a comparative example of the embodiment.

FIG. 4 is a diagram for explanation of a relationship among pressing force Fb of the cleaning blade 40, pulling force Fc of the coil spring 70, and driving force Fo of the auger 50.

The auger 50 has a driven gear 50*a* receiving a rotational driving force from the outside on one end of the rotational shaft thereof. On the other hand, an auger drive mechanism (not shown) as drive providing means (or drive provision mechanism), for example, a mechanism including a driving motor is provided at the main body side of the image forming apparatus 1 outside of the intermediate transfer belt cleaner 21, and transmits the driving force Fo to the driven gear 50*a* of the auger 50 via a drive gear 50*b* that the auger drive mechanism has.

Assuming that the mesh point of the drive gear 50*b* and the driven gear 50*a* is "C" and the distance from the mesh point C to the rotational support 38 of the casing 30 is Lo, the driving force Fo acts in the tangential direction at the mesh point C, and moment Mo ($Mo=Fo \cdot Lo$) is produced about the rotational support 38 by the driving force Fo. When the rotational directions of the respective gears are directions of arrows in the drawing, the moment Mo is counterclockwise.

On the other hand, assuming that the attachment point of the coil spring 70 and the casing 30 is "A" and the distance from the attachment point A to the rotational support 38 of the casing 30 is Lc, clockwise moment Mc ($Mc=Fc \cdot Lc$) acts about the rotational support 38 by the pulling force Fc of the coil spring 70.

Further, assuming that the contact point of the cleaning blade 40 and the intermediate transfer belt 17 is "B" and the distance from the contact point B to the rotational support 38 of the casing 30 is Lb, counterclockwise moment Mb ($Mb=Fb \cdot Lb$) acts about the rotational support 38 by (the drag Fc of) the pressing force Fb.

The following equation holds because of the balance among these moments, $$Mc=Mb+Mo \quad \text{(Eq. 1)}$$

That is, $$Fc \cdot Lc=Fb \cdot Lb+Fo \cdot Lo \quad \text{(Eq. 2)}$$

From (Eq. 2), the pressing force Fb of the cleaning blade 40 is expressed by $$Fb=Fc \cdot (Lc/Lb)-Fo \cdot (Lo/Lb) \quad \text{(Eq. 3)}$$

Note that, in the above respective equations, all of the directions of the respective axes extending from the rotational support 38 and the directions of action of the respective forces are perpendicular as in the form shown as an example in FIG. 4.

By the way, it has turned out that, when waste toner collects in the casing 30, and, when the amount of waste toner and the mobility of waste toner vary, the load torque of the auger 50 varies, and consequently, the driving force Fo of the auger 50 varies.

Especially, when the amount of waste toner is larger or the mobility of toner becomes lower at the time of low temperature environment or the like, the load torque of the auger 50 becomes greater and the driving force Fo of the auger 50 also becomes greater in order to counteract the increase in load torque. Further, depending on temperature environment or the like, sometimes the drive gear 50*b* and the driven gear 50*a* or the bearing portions thereof expand and contract, and consequently, the driving force Fo may vary.

In (Eq. 3), the pulling force Fc of the coil spring 70 and the distances from the rotational support 38 to the application points of the respective forces Lc, Lb, and Lo are controllable values (values that can be set to certain fixed values) in the design phase, adjustment phase at the time of manufacturing, or the like. Contrary, the driving force Fo of the auger 50 changes due to variations in load torque, variations in temperature environment, etc. as described above. Accordingly, the pressing force Fb of the cleaning blade 40 will vary due to the driving of the auger 50.

In order to obtain an allowable variation range of the pressing force Fb, the inventors have quantitatively measured the force Fb of the cleaning blade 40 pressing against the intermediate transfer belt 17 using a piezoelectric element.

As a result, a conclusion that a range of the linear pressure P (P=Fb/W; W indicates the longitudinal width of the rubber portion of the cleaning blade 40) from 1.5 to 2.0 g·f/mm (14.8 to 19.8 N/m) is optimum is obtained. That is, a result of 1.5 to 2.0 g·f/mm as the allowable variation range of the linear pressure P and 0.5 g·f/mm as the allowable fluctuation band $\Delta P_1$ is obtained.

When the linear pressure P is equal to or less than 1.5 g·f/mm, the residual toner slips through between the cleaning blade 40 and the intermediate transfer belt 17 to cause defective cleaning, and smudges appear in the image. Contrary, when the linear pressure P is equal to or more than 2.0 g·f/mm, the cleaning blade 40 is flipped due to friction between the intermediate transfer belt 17 and the cleaning blade 40.

On the other hand, in the case where the above described variation in the driving force Fo of the auger 50 is eliminated, considering variations in pulling force of the coil spring 70 alone and structure variations in manufacturing, the variation range of the linear pressure P of the cleaning blade 40 can be controlled in a range of fluctuation band $\Delta P_2$ of 0.3 g·f/mm (e.g., a range of 1.7 to 2.0 g·f/mm (16.8 to 19.8 N/m)).

Contrary, in the form shown in FIG. 4, that is, in the form in which the angle θo formed by the vector from the rotational support 38 toward the mesh point C of the gear and the vector of the driving force Fo acting on the mesh point C (hereinafter, the angle θo is referred to as "driving angle θo") is about 90 degrees, it was found that the fluctuation band $\Delta P_3$ of the linear pressure of the cleaning blade 40 received when the auger 50 drives is 0.4 g·f/mm (4.0 N/m) at the maximum.

As a result, when the fluctuation band $\Delta P_3$ (0.4 g·f/mm) due to the variation in the driving force Fo of the auger 50 is added to the controllable fluctuation band $\Delta P_2$ (0.3 g·f/mm) of the linear pressure P, the total fluctuation band ($\Delta P_2+\Delta P_3$) becomes 0.7 g·f/mm, which exceeds 0.5 g·f/mm as the allowable fluctuation band $\Delta P_1$.

That is, since the total fluctuation band ($\Delta P_2+\Delta P_3$) is 0.7 g·f/mm, the obtained range of linear pressure P is, for example, from 1.3 to 2.0 g·f/mm, which exceeds the allowable variation range of linear pressure P of 1.5 to 2.0 g·f/mm.

In order to keep the variation range of the linear pressure P of the cleaning blade 40 within the allowable variation range, the fluctuation band $\Delta P_3$ due to the variation in the driving force Fo of the auger 50 may be reduced.

As a measure of reduction, the inventors have focused attention on the fact that the variation in pressure force Fb (i.e., variation in linear pressure P) acts not directly as the variation in driving force Fo, but acts as moment Mo about the rotational support 38 by the driving force Fo.

That is, in the form shown in FIG. 4, since the driving angle θo is about 90 degrees, the moment Mo about the rotational support 38 by the driving force Fo appearing in (Eq. 2) becomes Fo·Lo. On the other hand, when the driving angle θo is set to a value other than 90 degrees, the moment Mo becomes Fo·Lo·sin θo.

Rewriting (Eq. 3) into fluctuation band ΔP of linear pressure P, the following (Eq. 4) is obtained.

$$\Delta P=-\Delta Fo \cdot (Lo/Lb)/W \quad \text{(Eq. 4)}$$

Furthermore, when the driving angle θo is not 90 degrees, (Eq. 4) is expressed by the following (Eq. 5).

$$\Delta P=-\Delta Fo \cdot \sin \theta o \cdot (Lo/Lb)/W \quad \text{(Eq. 5)}$$

As known from (Eq. 4) and (Eq. 5), the fluctuation band ΔP of linear pressure P is reduced to a value multiplied by sin θo (sin θo<1) by setting the driving angle θo to a value other than 90 degrees.

With the above described numeric values, when 0.4 g·f/mm of the fluctuation band $\Delta P_3$ due to the variation in the driving force Fo of the auger 50 is reduced to the half, 0.2 g·f/mm, the total fluctuation band ($\Delta P_2+\Delta P_3$) becomes 0.5 g·f/mm, and it can be kept within 0.5 g·f/mm as the allowable fluctuation band $\Delta P_2$. For the purpose, the driving angle θo may be set to an angle that satisfies $$|\sin \theta o| \leqq 1/2 \quad \text{(Eq. 6)}$$

Specifically, the driving angle θo may be set to one of the ranges below.

$$330° \leqq \theta o \leqq 0° \text{ or } 0° \leqq \theta o \leqq 30° \quad \text{(Eq. 7)}$$

$$150° \leqq \theta o \leqq 210° \quad \text{(Eq. 8)}$$

In order to minimize the fluctuation band $\Delta P_3$, it may be set to θo=0° or θo=180°, that is, the direction of the driving force Fo may be set to a direction toward the rotational support 38 or a direction opposite thereto.

Figure 5:
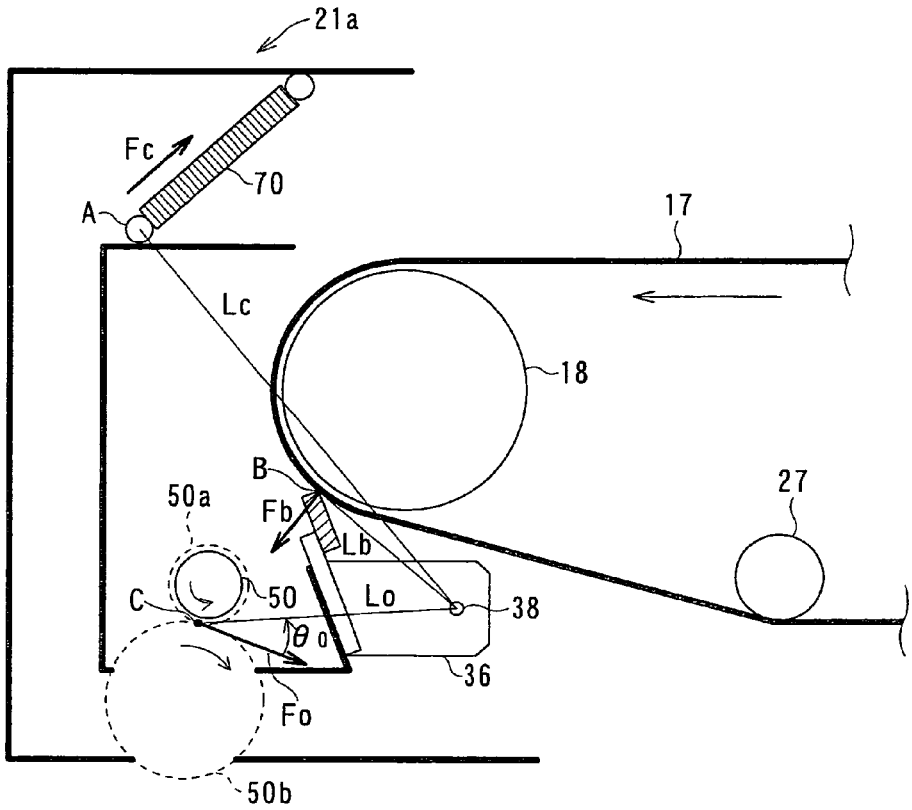
FIG. 5 shows a configuration example of a toner cleaner according to the first embodiment.
Figure 6:
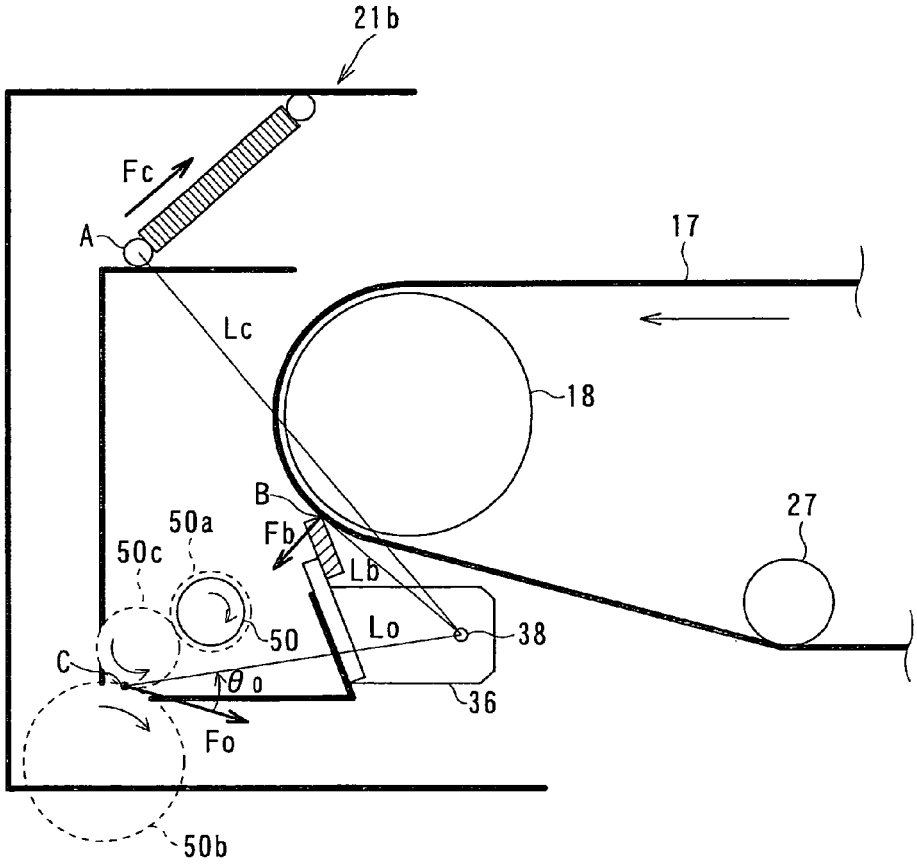
FIG. 6 shows a configuration example of a toner cleaner according to the second embodiment.
Figure 7:
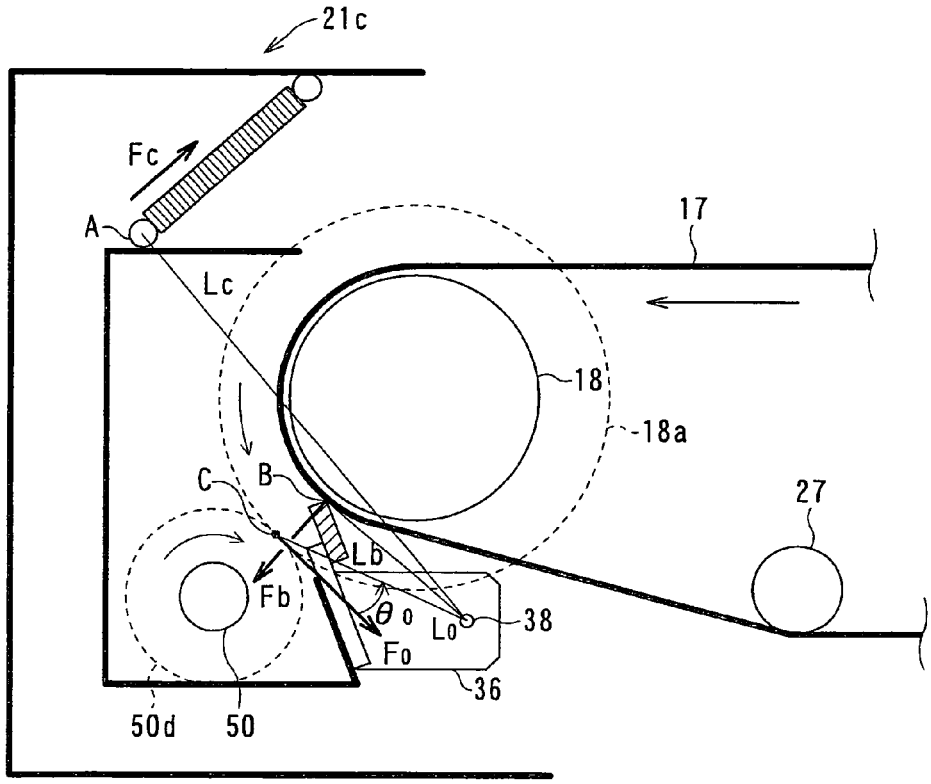
FIG. 7 shows a configuration example of a toner cleaner according to the third embodiment.

Embodiments of the intermediate transfer belt cleaner 21 based on the above consideration are shown in FIGS. 5 to 7.

FIG. 5 shows a configuration example of an intermediate transfer belt cleaner 21*a* according to the first embodiment of the invention. In the intermediate transfer belt cleaner 21*a* according to the first embodiment, the drive gear 50*b* for driving the auger 50 is located below the auger 50 in FIG. 5. By the location, the driving angle θo can be set smaller than 30°, and the variation in linear pressure P of the cleaning blade 40 due to the variation in driving force Fo can be reduced to the half of or less than that in the form in FIG. 4.

FIG. 6 shows a configuration example of an intermediate transfer belt cleaner 21*b* according to the second embodiment of the invention. The intermediate transfer belt cleaner 21*b* according to the second embodiment has a form in which an intermediate driven gear 50*c* is provided between the drive gear 50*b* for driving the auger 50 and the driven gear 50*a* provided on the rotational shaft of the auger 50. The intermediate driven gear 50*c* is provided as a component of the intermediate transfer belt cleaner 21. In the embodiment, the driving force Fo acts at the mesh point C of the drive gear 50*b* and the intermediate driven gear 50*c* in the tangential direction of both gears. Also, in the embodiment, since the drive gear 50*b* is located below the intermediate driven gear 50*c* in FIG. 5, the driving angle θo can be set smaller than 30°, and the variation in linear pressure P of the cleaning blade 40 due to the variation in driving force Fo can be reduced to the half of or less than that in the form in FIG. 4.

FIG. 7 shows a configuration example of an intermediate transfer belt cleaner 21*c* according to the third embodiment of the invention. The intermediate transfer belt cleaner 21*c* according to the third embodiment has a form in which a drive gear 18*a* for driving the auger 50 is provided coaxially with the driving roller 18 of the intermediate transfer belt 17. The driving roller 18 rotates by receiving a driving force from drive providing means such as a driving motor (not shown), and the drive gear 18*a* transmits the rotational driving force to a driven gear 50*d* of the auger 50 as one component of the drive providing means.

In the intermediate transfer belt cleaner 21*c* according to the third embodiment, the driving force Fo acts at the mesh point C of the drive gear 18*a* and the driven gear 50*d* in the tangential direction of both gears. Also, in the embodiment, as shown in FIG. 7, the form in which the driving angle θo is set smaller than 30° is adopted, and the variation in linear pressure P of the cleaning blade 40 due to the variation in driving force Fo can be reduced to the half of or less than that in the form in FIG. 4.

As described above, according to the intermediate transfer belt cleaners 21*a*, 21*b*, and 21*c* according to the respective embodiments, the variation in pressing force Fb of the cleaning blade for cleaning residual toner of the intermediate transfer belt 17 can be reduced and the cleaning performance of the cleaning blade can be stabilized.

Thus far, the intermediate transfer belt cleaner 21 for cleaning residual toner on the intermediate transfer belt 17 (image carrier) has been described, however, the invention can be applied to toner cleaners for cleaning residual toner on photoconductors and transfer belts. In these toner cleaners, the basic structure that the waste toner removed by the cleaning blade is transported to the outside of the toner cleaner using the auger is also common.

Figure 8:
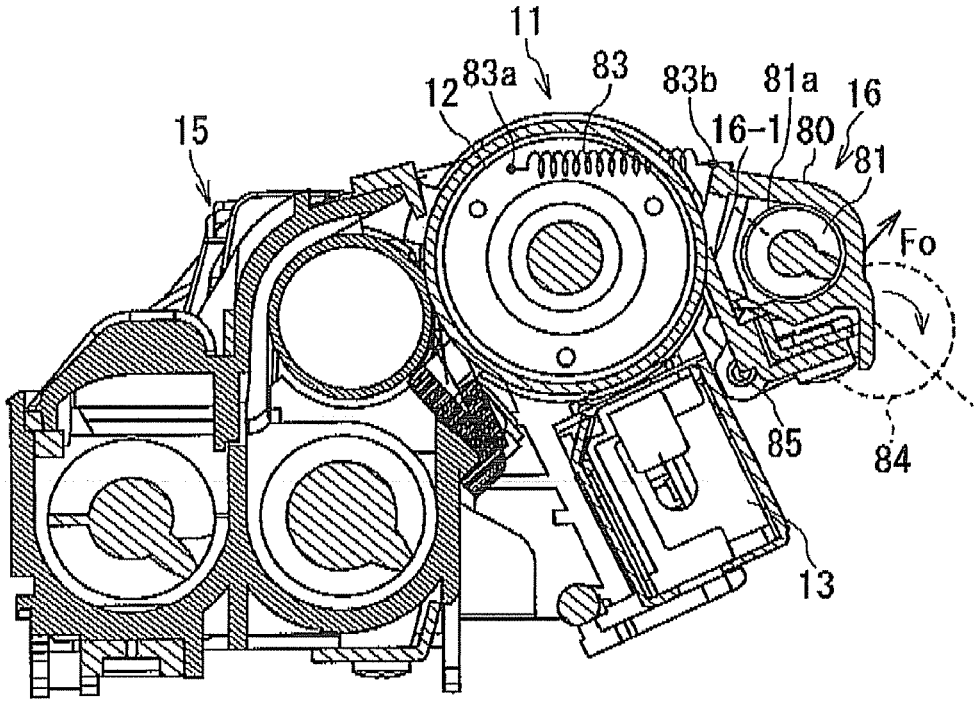
FIG. 8 shows a configuration example of a toner cleaner according to an embodiment in which toner left on a surface of a photoconductor is removed.

FIG. 8 shows an example in which the above described embodiment is applied to the toner cleaner 16 of the process cartridge 11 shown in FIG. 2.

One end of a coil spring 83 is fixed to an upper end 83*b* of the toner cleaner 16, and the other end 83*a* of the coil spring 83 is fixed to a case (not shown) of the process cartridge 11. A casing 80 of the toner cleaner 16 is rotatably supported by a rotational support 85 and a cleaning blade 16-1 fixed to the casing 80 is pressed against the surface of the photoconductor 12 by a pulling force of the coil spring 83. The waste toner scraped by the cleaning blade 16-1 is collected within the casing 80, transported by an auger 81 in the shaft direction (the direction perpendicular to the paper surface), and ejected to the outside of the casing 80.

The auger 81 coaxially has a driven gear 81*a*, and is driven by a drive gear 84 provided in the main body of the image forming apparatus 1. The driving force Fo acts in the tangential direction from the mesh point of the driven gear 81*a* and the drive gear 84 as shown in FIG. 8.

As shown in FIG. 8, the direction from the mesh point toward the rotational support 85 and the direction of the driving force Fo is arranged so as to be substantially the same (θo≈0°). As a result, the moment about the rotational support 85 by the driving force Fo becomes smaller and the influence on the pressing force of the cleaning blade 16-1 is reduced.

Note that the invention is not limited to the above embodiments as they are, but the component elements can be modified and embodied without departing from the scope thereof in the implementation phase. Further, various inventions can be formed by appropriate combinations of plural component elements disclosed in the above embodiments. For example, some component elements may be deleted from all component elements shown in the embodiments. Furthermore, component elements over the different embodiments may be combined appropriately.

What is claimed is:

1. An image forming apparatus comprising:

an image carrier; and a cleaning device for cleaning a developer left on a surface of the image carrier, the cleaning device including:

a casing having a rotational shaft;

pressurizing means for applying a force about the rotational shaft to the casing;

a cleaning member provided in the casing for cleaning the developer left on the surface of the image carrier by being partly pressed against the surface of the image carrier by the force about the rotational shaft;

transporting means accommodated in the casing for transporting the cleaned developer collecting within the casing to a predetermined position outside of the casing; and drive providing means for providing a driving force to the transporting means, wherein a direction of the driving force is a direction from an application point of the driving force substantially toward a rotational support of the rotational shaft or a direction opposite thereto.

2. An image forming apparatus according to claim 1, wherein an angle θ formed by a vector of the driving force and a vector from the application point of the driving force provided to the transporting means to the rotational support is an angle θ that satisfies $$-\frac{1}{2} \leqq \sin\theta \leqq \frac{1}{2}.$$

3. An image forming apparatus according to claim 1, wherein the image forming apparatus includes an image forming apparatus main body having the image carrier and the cleaning device, and the drive providing means is provided in the image forming apparatus main body.

4. An image forming apparatus according to claim 1, wherein the driving force is a rotational driving force and the rotational driving force is provided from the drive providing means to the transporting means via a gear that the drive providing means has and a gear that the transporting means has.

5. An image forming apparatus according to claim 1, wherein the image carrier is an intermediate transfer body onto which a developer image formed on the surface of a photoconductor that the image forming apparatus has is intermediately transferred.

6. An image forming apparatus according to claim 1, wherein the image carrier is a photoconductor on a surface of which a toner image is formed by a developing unit that the image forming apparatus has.

7. An image forming apparatus according to claim 6, wherein at least one of the photoconductor and the developing unit is accommodated in a process cartridge arranged detachably from the image forming apparatus.

8. An image forming apparatus comprising:

an image carrier; and a cleaning device configured to clean a developer left on a surface of the image carrier, the cleaning device including:

a casing having a rotational shaft;

a pressurizing member configured to apply a force about the rotational shaft to the casing;

a cleaning member provided in the casing configured to clean the developer left on the surface of the image carrier by being partly pressed against the surface of the image carrier by the force about the rotational shaft;

a transport mechanism accommodated in the casing configured to transport the cleaned developer collecting within the casing to a predetermined position outside of the casing; and a drive provision mechanism configured to provide a driving force to the transporting means, wherein a direction of the driving force is a direction from an application point of the driving force substantially toward a rotational support of the rotational shaft or a direction opposite thereto.

9. An image forming apparatus according to claim 8, wherein an angle θ formed by a vector of the driving force and a vector from the application point of the driving force provided to the transport mechanism to the rotational support is an angle θ that satisfies $$-\frac{1}{2} \leqq \sin\theta \leqq \frac{1}{2}.$$

10. An image forming apparatus according to claim 8, wherein the image forming apparatus includes an image forming apparatus main body having the intermediate transfer body and the cleaning device, and the drive provision mechanism is fixed to the image forming apparatus main body.

11. An image forming apparatus according to claim 8, wherein the driving force is a rotational driving force and the rotational driving force is provided from the drive provision mechanism to the transport mechanism via a gear that the drive provision mechanism has and a gear that the transport mechanism has.

12. An image forming apparatus according to claim 8, wherein the image carrier is an intermediate transfer body onto which a developer image formed on the surface of a photoconductor that the image forming apparatus has is intermediately transferred.

13. An image forming apparatus according to claim 8, wherein the image carrier is a photoconductor on a surface of which a toner image is formed by a developing unit that the image forming apparatus has.

14. An image forming apparatus according to claim 13, wherein at least one of the photoconductor and the developing unit is accommodated in a process cartridge arranged detachably from the image forming apparatus.

15. An image forming method of an image forming apparatus comprising:

exposing a surface of a photoconductor to light of an electrostatic latent image;

developing the electrostatic latent image with toner to develop a toner image on the surface of the photoconductor;

transferring the toner image on the surface of the photoconductor onto an intermediate transfer body;

transferring a transferred image transferred to the intermediate transfer body onto a recording medium; and cleaning toner left on the intermediate transfer body or photoconductor, the cleaning including:

applying a force about a rotational shaft to a casing having the rotational shaft;

scraping the toner left on the surface of the intermediate transfer body or photoconductor by a cleaning blade fixed to the casing and partly pressed against the surface of the intermediate transfer body or photoconductor by the force about the rotational shaft;

transporting the toner scraped into the casing to a predetermined position outside of the casing by an auger accommodated in the casing; and providing a driving force to the auger, wherein a direction of the driving force is a direction from an application point of the driving force substantially toward a rotational support of the rotational shaft or a direction opposite thereto.

16. An image forming method according to claim 15, wherein an angle θ formed by a vector of the driving force and a vector from the application point of the driving force provided to the auger to the rotational support is an angle θ that satisfies $$-\frac{1}{2} \leqq \sin\theta \leqq \frac{1}{2}.$$

17. An image forming method according to claim 15, wherein an auger drive mechanism provided outside of the casing provides the driving force to the auger.

18. An image forming method according to claim 17, wherein the driving force is a rotational driving force and the rotational driving force is provided from the auger drive mechanism to the auger via a gear that the auger drive mechanism has and a gear that the auger has.

19. An image forming method according to claim 15, wherein at least one of the photoconductor and the developing unit is accommodated in a process cartridge arranged detachably from the image forming apparatus.

* * * * *